US007604496B2

(12) United States Patent
Takeuchi et al.

(10) Patent No.: US 7,604,496 B2
(45) Date of Patent: Oct. 20, 2009

(54) ELECTRICAL CONNECTOR

(75) Inventors: Yousuke Takeuchi, Tokyo (JP); Tadashi Sakaizawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/896,191

(22) Filed: Aug. 30, 2007

(65) Prior Publication Data

US 2008/0090441 A1 Apr. 17, 2008

(30) Foreign Application Priority Data

Oct. 17, 2006 (JP) ..... 2006-282846

(51) Int. Cl.
*H01R 13/627* (2006.01)

(52) U.S. Cl. ..... 439/358

(58) Field of Classification Search ..... 439/353–358
See application file for complete search history.

(56) References Cited

U.S. PATENT DOCUMENTS

| | | | | |
|---|---|---|---|---|
| 5,277,627 | A * | 1/1994 | Matsuzaki | 439/677 |
| 6,280,227 | B1 * | 8/2001 | Terada et al. | 439/357 |
| 6,290,530 | B1 * | 9/2001 | Chang | 439/378 |
| 6,786,755 | B2 * | 9/2004 | Dambach et al. | 439/353 |
| 6,976,876 | B1 * | 12/2005 | Su et al. | 439/607 |
| 6,997,733 | B2 * | 2/2006 | Peng | 439/353 |
| 7,422,465 | B2 * | 9/2008 | Watanabe et al. | 439/353 |
| 7,425,155 | B2 * | 9/2008 | Takeuchi | 439/607 |
| D584,692 | S * | 1/2009 | Koyama et al. | D13/147 |
| 2004/0209509 | A1 * | 10/2004 | Okamura et al. | 439/357 |
| 2005/0245132 | A1 * | 11/2005 | Huang et al. | 439/607 |
| 2005/0282424 | A1 * | 12/2005 | Huang et al. | 439/353 |
| 2007/0141890 | A1 * | 6/2007 | Koyama | 439/358 |
| 2007/0141891 | A1 * | 6/2007 | Koyama et al. | 439/358 |

FOREIGN PATENT DOCUMENTS

| | | | |
|---|---|---|---|
| JP | 09-139261 | | 5/1997 |
| JP | 2004-273431 | | 9/2004 |
| JP | 3108062 | | 1/2005 |
| JP | 3109417 | | 3/2005 |
| JP | 2005-530309 | | 10/2005 |
| WO | WO2004/015819 | * | 2/2004 |

OTHER PUBLICATIONS

European Search Report, Feb. 12, 2008.

* cited by examiner

*Primary Examiner*—Renee S Luebke
*Assistant Examiner*—Larisa Tsukerman
(74) *Attorney, Agent, or Firm*—Kubotera & Associates, LLC

(57) ABSTRACT

An electrical connector to be connected to a mating connector includes a housing; a terminal; and a locking piece arranged in parallel to the terminal for engaging the mating connector. The locking piece includes a base portion; an arm portion movable by a specific amount; a fixing portion fixed to the housing; and a regulating portion fixed to the housing. The arm portion extends from the base portion toward the mating connector via a bent portion, and has a locking portion for engaging an engaged portion of the mating connector at a distal thereof. The fixing portion extends from the base portion toward the mating connector. The regulating portion is situated on an opposite side of the fixing portion with respect to the base portion, and extends from the base portion in a moving direction of the arm portion.

6 Claims, 7 Drawing Sheets

ELECTRICAL CONNECTOR

BACKGROUND OF THE INVENTION AND RELATED ART STATEMENT

The present invention relates to an electrical connector. More specifically, the present invention relates to a plug type connector to be provided in an end portion of a cable.

In a cellular phone, a PDA, and other portable electronic devices, an electrical connector (plug connector) provided in an end portion of a cable may be fitted into a connector (receptacle connector) of an electronic device for transmitting a signal or recharging. The electrical connector may be provided with a locking mechanism for reliably fitting to the connector, thereby avoiding being inadvertently unplugged from the connector of the electronic device. Further, the electrical connector may be plugged and unplugged several tens of thousands of times, and thereby required to have a reliable locking mechanism to maintain a locking force.

A connector with a locking mechanism has been disclosed in Patent Reference 1. The electrical connector disclosed in Patent Reference 1 is provided with a U-shape elastic metal member as a locking piece. The elastic member includes an elastic arm portion having an engaging portion to engage with an engaged portion of a mating connector; a fixing portion to press to fix to a housing; and a bent portion to connect the elastic arm portion and the fixing portion.

When the electrical connector and the mating connector are fitted, the electrical connector and the mating connector are locked through an elastic displacement of the elastic arm portion. When the electrical connector is unplugged from the mating connector, an operating portion of the electrical connector is operated to deform the elastic arm portion along a displacement direction with respect to the elastic arm portion, so that the engaging portion is disconnected from the engaged portion.

In the electrical connector described above, it is necessary to operate the operating portion to disconnect the electrical connector from the mating connector. Accordingly, it is possible to prevent the electrical connector from being unplugged inadvertently from the mating connector. Further, the locking mechanism is reliable since no excessive deformation force is imposed on the elastic member.

In Patent Reference 2, a connector with a simplified locking mechanism is disclosed. The connector may be unplugged without operating an operating portion. A pair of locking pieces of the connector is provided on both ends of a connection terminal thereof to press to fit into a housing. In the connector, a distal of an arm portion engages with an engaged portion of the mating connector to function as a locking mechanism. When the connector is unplugged, the locking pieces are displaced to unlock.

Patent Reference 1: Japanese Utility Model Publication No. 3109417

Patent Reference 2: Japanese Utility Model Publication No. 3108062

In Patent Reference 1, the connector is reliable when fitted. However, it is necessary to operate the operation portion to impose the unlocking force in the displacement direction with respect to the U-shape elastic member to unlock. Accordingly, it is necessary to increase a size of the connector in a height direction thereof (displacement direction), thereby making it difficult to reduce a size of the connector to meet a recent trend.

Further, when an excessive stress is imposed on the connector in a pull-out direction, the connector may be damaged.

For example, when a cable is pulled from the connector in a fitted state, the connector may be damaged.

In the connector disclosed in Patent Reference 2, the arm portion of the locking piece is displaced through repeated plug and unplug actions, thereby generating a stress to rotate the locking pieces to a displacement direction upon every displacement of the arm portion. Accordingly, it is difficult to securely fix the locking pieces to the housing. As a result, the locking pieces fixed to the housing may come off the housing over time, so that the locking pieces are not held in the housing tightly when the connector is plugged or unplugged, thereby decreasing a locking strength and deteriorating reliable lock.

Further, when the outside cover is formed, a resin may flow into and be solidified in a space between the locking pieces and the housing. Accordingly, when the locking pieces are displaced, the resin becomes an obstacle and changes spring function, thereby deteriorating reliable lock.

In view of the problems described above, an object of the present invention is to provide a small connector with a reliable lock. Another object of the present invention is to provide a connector in which a resin does not flow into a locking piece area when an outside cover is formed of the resin.

Further objects and advantages of the invention will be apparent from the following description of the invention.

SUMMARY OF THE INVENTION

In order to attain the objects described above, according to the present invention, an electrical connector to be connected to a mating connector includes a housing; a terminal; and a locking piece arranged in parallel to the terminal for engaging the mating connector. The locking piece includes a base portion; an arm portion movable by a specific amount; a fixing portion fixed to the housing; and a regulating portion fixed to the housing. The arm portion extends from the base portion toward the mating connector via a bent portion, and has a locking portion for engaging an engaged portion of the mating connector at a distal thereof. The fixing portion extends from the base portion toward the mating connector. The regulating portion is situated on an opposite side of the fixing portion with respect to the base portion and extends from the base portion in a moving direction of the arm portion.

In the electrical connector described above, the regulating portion may include a narrow width portion situated on a side of the base portion and a wide width portion situated on a side of a free edge thereof.

In the electrical connector described above, the housing may include a pressed portion disposed between the arm portion and the fixing portion. The fixing portion has a pressed protrusion pressed into the pressed portion.

Further, in the electrical connector described above, the locking piece may include an abutting portion disposed between the locking piece and the bent portion for abutting against an inner wall of the housing.

Further, in the electrical connector described above, the locking piece may have a flat shape.

Further, in the electrical connector described above, the locking portion may include a side surface having a convex shape. The locking portion includes a front sloping surface facing the mating connector and having a first angle and a rear sloping surface on an opposite side of the front sloping surface having a second angle larger than the first angle.

According to the present invention, it is possible to reduce a size of the electrical connector in a displacement direction of the locking piece while effectively preventing a locking force from decreasing. Further, it is possible to effectively prevent a resin from flowing into a locking piece area when an outside cover is formed of a resin.

DETAILED DESCRIPTION OF THE PREFERRED EMBODIMENTS

Hereunder, embodiments of the present invention will be explained with reference to the accompanying drawings. An electrical connector is explained as an example.

Figure 1:
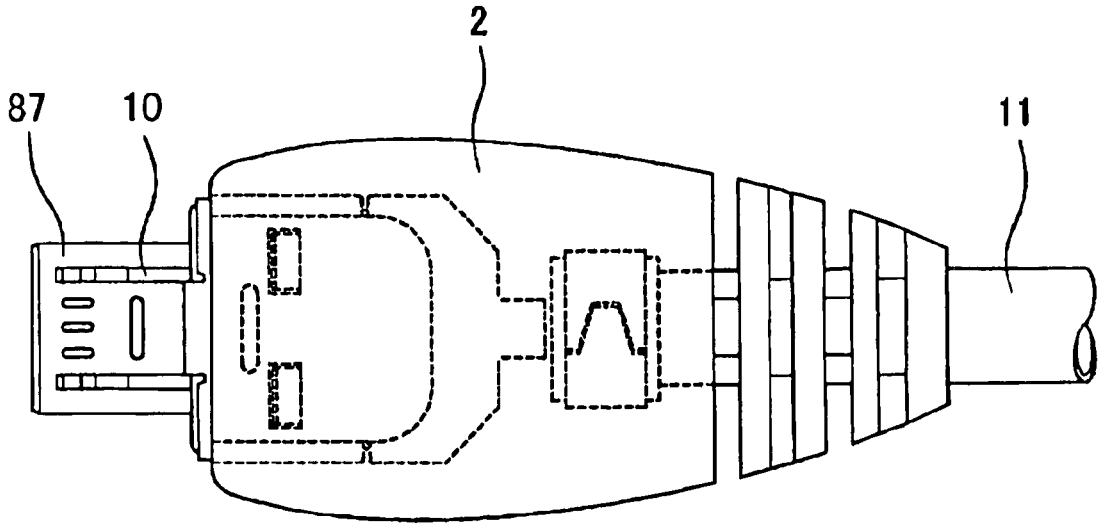
FIG. 1 is a plan view showing an electrical connector according to an embodiment of the present invention.
Figure 2:
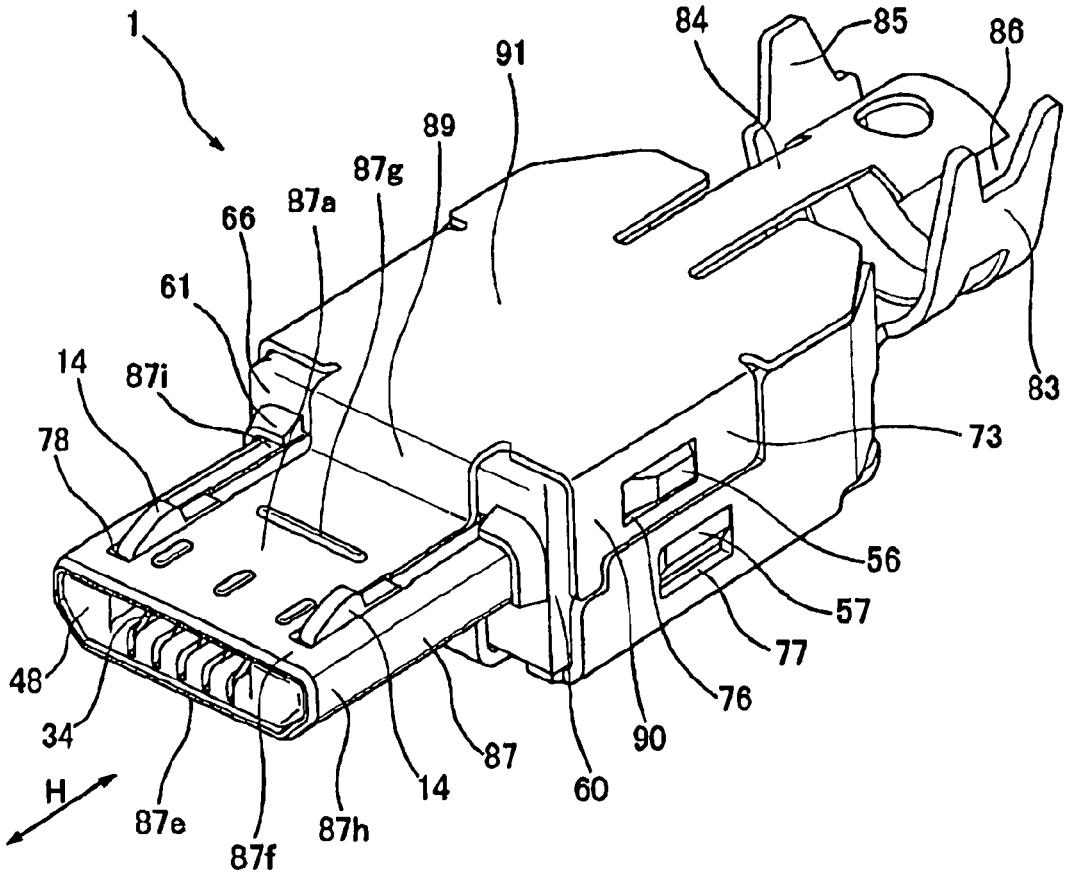
FIG. 2 is an upper perspective view showing the electrical connector before an outside cover is formed of a resin according to the embodiment of the present invention.
Figure 3:
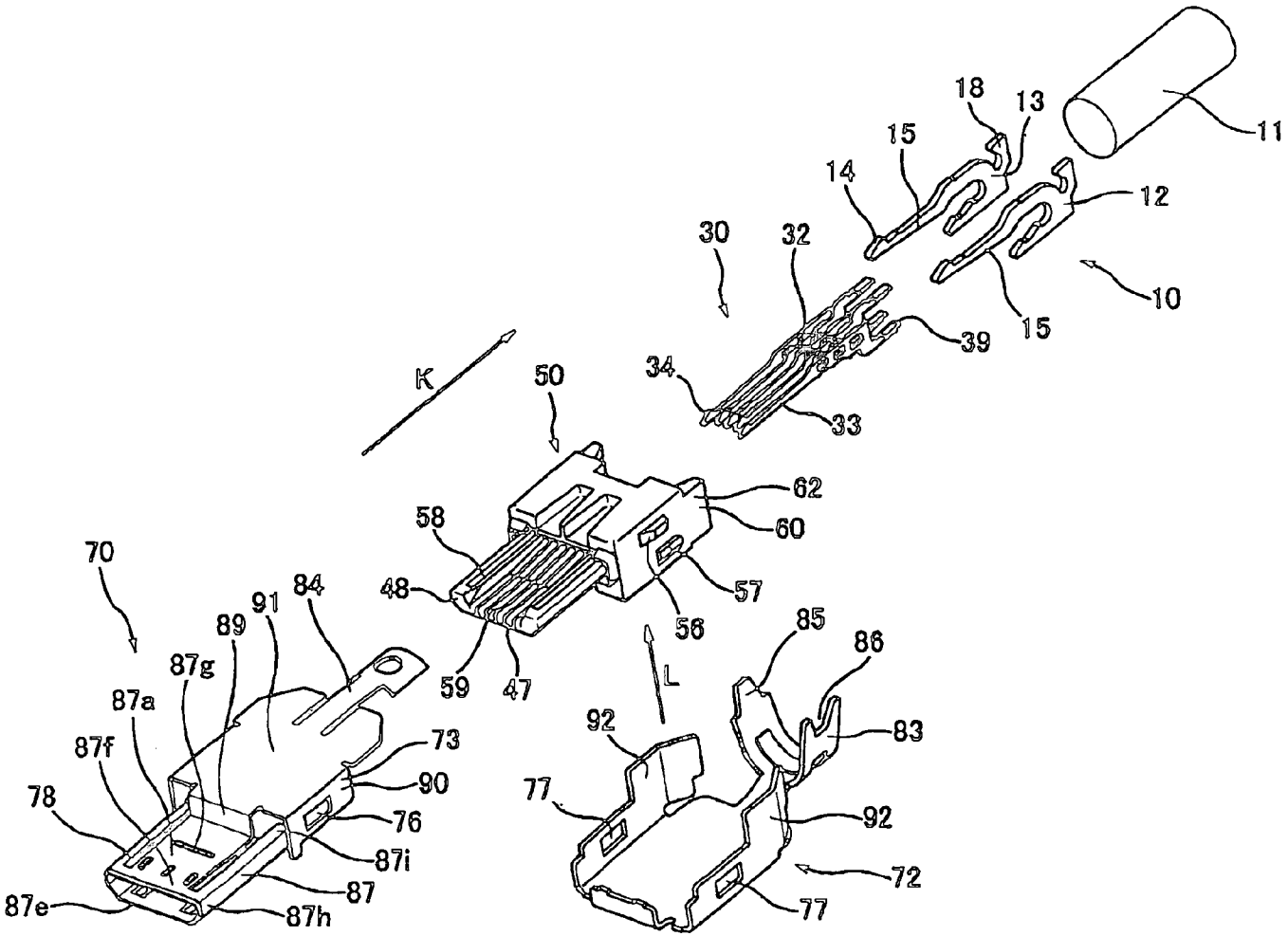
FIG. 3 is an exploded perspective view showing the electrical connector according to the embodiment of the present invention.

FIG. 1 is a plan view showing an electrical connector 1 according to an embodiment of the present invention. FIG. 2 is an upper perspective view showing the electrical connector before an outside cover 2 is formed of a resin according to the embodiment of the present invention. FIG. 3 is an exploded perspective view showing the electrical connector 1 according to the embodiment of the present invention.

In the embodiment, the electrical connector 1 mainly comprises a housing 50 integrally formed of a resin or the like; shield members 70 and 72 formed of thin metal plates by punching out and bending; terminals 30 in a flat plate shape formed of thin metal plates by punching out; and locking pieces 10 having a flat shape. The shield members 70 and 72 comprise a first shielding member 70 and a second shielding member 72 having complimentary shapes. The shielding members 70 and 72 are attached to an outer circumference of the housing 50 in a pair. A total of five terminals 30 are arranged inside the housing 50 in a row in parallel to a longitudinal direction with a narrow pitch. Further, two locking pieces 10 are arranged in parallel to the terminals 30 in the housing 50, so that the locking pieces 10 sandwich the terminals 30 from both sides.

In the embodiment, the electrical connector 1 is used as a plug connector. In an operation, for example, the plug connector 1 may be attached to or detached from a mating connector in a direction indicated with an arrow "H" in FIG. 2. The mating connector is a receptacle connector provided on a substrate or board. Further, in the electrical connector 1, a housing fitting portion 58 on a distal not covered with an outside cover 2 (shown in FIG. 1) formed of a resin and a shield fitting portion 87 in a tubular shape may fit into the receptacle connector in a detachable manner.

As shown in FIG. 3, members other than the second shielding member 72 may be fitted into, for example, each other in an arrangement direction that is a straight line indicated with an arrow "K" in FIG. 3. First, the terminals 30 and the locking pieces 10 are pressed to fit into the housing 50. Then, a lead (not shown) of a cable 11 is fixed to lead fixing portions 39 of the terminals 30 with solder.

Further, the first shielding member 70 is fitted into the housing 50, and the second shielding member 72 is fitted into the housing 50 from a direction indicated with an arrow "L". The first shielding member 70 and the second shielding member 72 substantially cover the housing fitting portion 58 and an outer circumferential of side surfaces and a rear edge side of the housing 50 when fitted into each other.

At the same time, the cable 11 is arranged such that a plate portion 84 of the first shielding member 70 and a caulking portion 83 of the second shielding member 72 sandwich the cable 11. Further, a convex portion 85 and a concave portion 86 provided at both ends of the caulking portion 83 of the second shielding member 72 are mutually complimentary. The convex portion 85 and the concave portion 86 are fitted to caulk the cable 11 and the plate portion 84 from an outer circumference thereof. As a result, the electrical connector 1 is shifted to an open state from a closed state (not shown) in a tubular shape, and the assembly is completed.

In the embodiment, a total of five terminals 30 are shown in FIG. 3, and the number of the terminals 30 is not limited to five. Two of the terminals 30 may be used for, for example, data communication; two terminals 30 may be used spares; and a remaining terminal 30 may be used for grounding. The terminals 30 may cancel positive and negative noises to maintain a transmission property when used in a pair.

A size and a length of a fixing portion 32 and an arm portion 33 of each terminal 30 are substantially identical in all terminals. The arm portion 33 is in a tapered shape toward a pressing direction and includes a contact portion 34 facing upwardly on a distal thereof. The contact portions 34 contact with contact portions of mating terminals of the mating connector when the electrical connector 1 and the mating connector are fitted. The contact portion 34 may send an electrical signal from the cable 11 to the mating connector.

Figure 4:
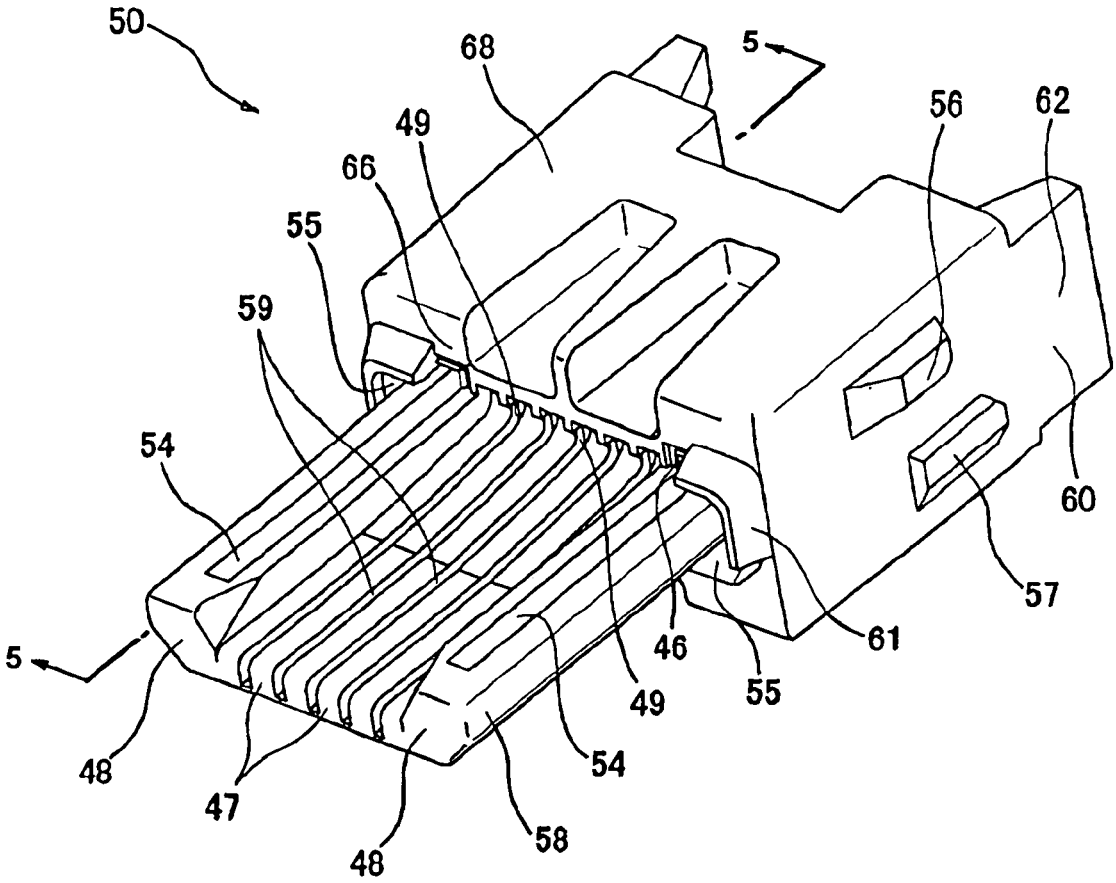
FIG. 4 is an enlarged perspective view showing a housing of the electrical connector according to the embodiment of the present invention.
Figure 5:
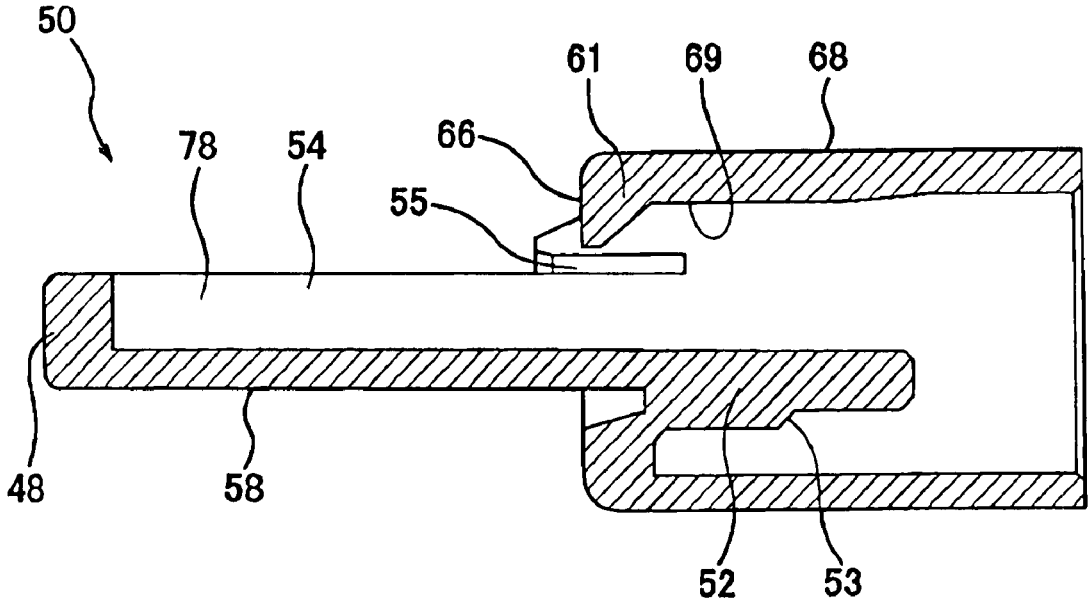
FIG. 5 is a sectional view taken along a line 5-5 in FIG. 4.

FIG. 4 is an enlarged perspective view of the housing 50. FIG. 5 is a sectional view of FIG. 4 taken along a line 4-4'. The housing 50 is provided with the housing fitting portion 58 having a plate shape and protruding toward a distal end thereof (mating connector). Grooves 55 are provided inside the housing 50 in an opposite direction of a protruding direction of the housing fitting portion 58 on a rear anchor side or base portion of the housing fitting portion 58.

In the embodiment, corresponding to the grooves 55, portions 87*i* of the rear anchor sides (shown in FIG. 3) of the first shielding member 70 protrude from a housing body portion 62 in the opposite direction of the mating connector. With the configuration, the grooves 55 may sandwich the portions 87*i* of the rear anchor sides of the first shielding member 70, so that the first shielding member 70 covers a larger area of the housing fitting portion 58. The strength of the housing fitting portion 58 is thereby improved. Further, it is possible to improve strength of the shielding fitting portion 87 protruding from a shielding body portion 73 where a twisting force is easily applied, thereby improving resistant of the connector against a twisting force.

In the embodiment, the terminals 30 and the locking pieces 10 are pressed into the housing 50 in parallel through vertical openings or holes (not shown) provided in a backside of the housing 50. At this time, the terminals 30 and the locking pieces 10 are pressed into the housing 50 without forming any gap at least in the direction that the terminals 30 and the locking pieces 10 are arranged. Accordingly, a resin to form the outside cover 2 does not flow into the holes at least in the arrangement direction.

In the embodiment, after the terminals 30 and the locking pieces 10 are pressed into the housing 50, an upper half of the arm portions 33 and the contact portions 34 are exposed through terminal openings 49 communicating with the vertical openings. Further, the arm portions 33 of the terminals 30 are elastically held along terminal grooves 59 of a thin wall portion 47 of the housing fitting portion 58.

Similarly, the locking pieces 10 are elastically held along the grooves 54 provided in the thick wall portion 48 of the housing fitting portion 58 through the locking holes 46 communicating with the vertical openings, in a state that an approximate upper half of the arm portion 15 and the locking portions 14 are exposed. When the electrical connector 1 fits into the mating connector, the locking pieces 10 engage with an engaged portion of the mating connector using the locking portions 14 elastically displaceable. The fitting state of the electrical connector 1 and the mating connector are thereby maintained.

Figure 6:
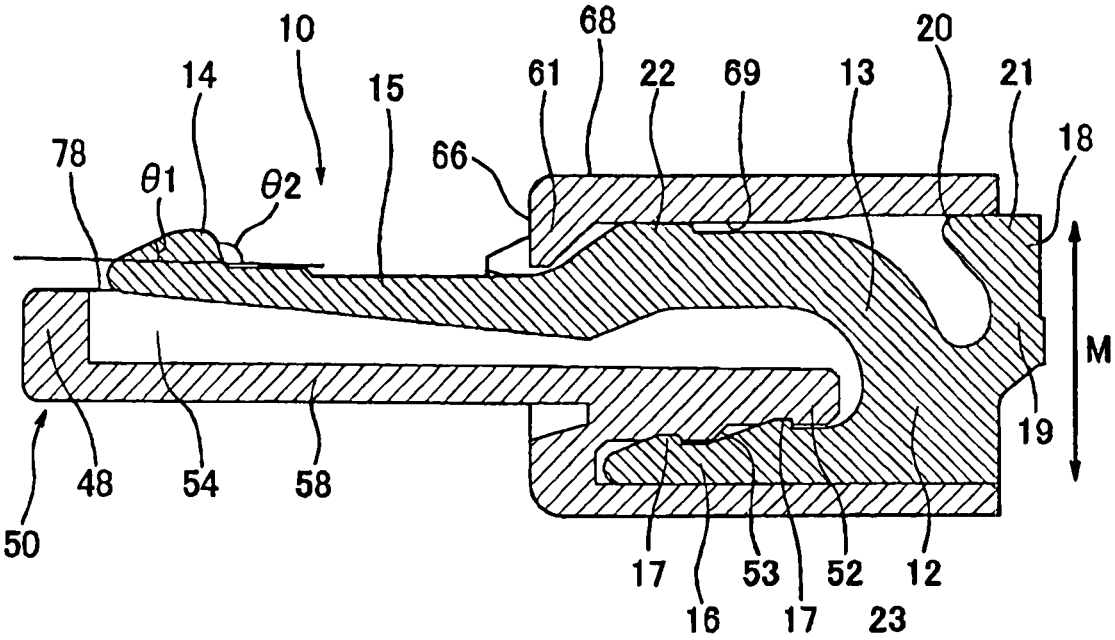
FIG. 6 is a sectional view similar to FIG. 5 showing the housing of the electrical connector in a state that a locking piece is attached.

FIG. 6 is a sectional view similar to FIG. 5 showing the housing 50 of the electrical connector 1 in a state that a locking piece is attached. As shown in FIG. 6, the locking pieces 10 are inserted into the housing 50 in a manner similar to FIG. 5. The locking piece 10 primarily comprises a base portion 12, a pressed fixing portion 16, and an arm portion 15. The pressed fixing portion 16 extends from the base portion 12 in a direction with respect to the mating connector, and the arm portion 15 extends in a direction with respect to the mating connector in an approximately parallel to the pressed fixing portion 16 from the base portion 12 via a bent portion 13.

When the electrical connector 1 is fitted into the housing 50, the pressed fixing portions 16 are pressed to fix to pressed portions 52 of the housing 50 using pressed protrusions 17 provided on the pressed fixing portions 16. The pressed portion 52 of the housing 50 are disposed between the arm portions 15 and the pressed fixing portions 16, and are provide with steps 53 corresponding to the pressed protrusions 17. Accordingly, a height of the locking pieces 10 is kept low enough while fixing to the housing 50 securely.

In the embodiment, the bent portions 13 make the arm portions 15 flexible. Accordingly, an approximate entire unit of the locking piece 10 may be elastically displaced at a specific amount in a height direction (displacement direction with respect to the arm portions 15 indicated with an arrow "M" in FIG. 6). The approximate entire unit includes an area around the locking portion 14 provided at a distal end of the arm portion 15.

When the locking pieces 10 are inserted into the housing 50, the locking portions 14 may be held to stand out against the housing 50 (a thin wall portion 47 of the housing fitting portion 58) by applying a preload while no stress is imposed. Accordingly, when the electrical connector 1 fits into the mating connector, the locking portions 14 securely engage with the engaged portions of the mating connector.

In order to apply the preload, for example, abutting portions 22 may be provided between the locking portions 14 and the bent portions 13 for abutting against an upper face inner wall 69 of a distal side of the housing 50, thereby controlling an amount that the arm portions 15 may be displaced upwardly. An excess upward displacement of the arm portions 15 may be prevented through a corner protruding portion 61 protruding frontward of the housing 50.

Accordingly, a displacement amount of the arm portions 15 of the locking pieces 10 may be regulated at a specific amount and metallic fatigue caused by repeated displacements is prevented because of the abutting portions 22. Further, a stable locking force may be obtained regardless of repeated plug and unplug actions.

In the embodiment, when the electrical connector 1 is plugged into or unplugged from the mating connector, the locking portions 14 may be naturally displaced in a height direction. The plug connector 1 and the mating connector are locked or unlocked spontaneously and easily through the plug and unplug actions.

As shown in FIG. 6, side surfaces of the locking portions 14 have a convex shape. Specifically, a sloping surface angle (θ1) of the mating connector side is to be smaller than a sloping surface angle (θ2) of an opposite side of the fitting side with respect to the mating connector. Accordingly, when the electrical connector 1 is plugged into the mating connector, the electrical connector 1 may be connected smoothly (without resistance force).

On the other hand, a certain amount of a force is required to unplug the electrical connector 1 from the mating connector. In the present invention, an operation portion to shift the locking portion 14 to the arm portion 15 is not provided as conventionally done. Accordingly, the electrical connector 1 is not enlarged to provide the operation portion.

In the electrical connector 1 of the present invention, a size thereof is reduced from that of a conventional connector through reducing the height direction to save spaces. While the electrical connector 1 is compact, a deterioration of a locking force and a damage on the electrical connector 1 due to the repeated plug and unplug actions may be prevented.

In the embodiment, regulating portions 18 are located on the opposite side of the direction the arm portions 15, and the pressed fixing portions 16 are extended from the base portions 12. In other words, the regulating portions 18 are located on the opposite side of the fitting side with respect to the mating connector and extend from the base portions 12 along a displacement direction with respect to the arm portions 15.

Figure 7:
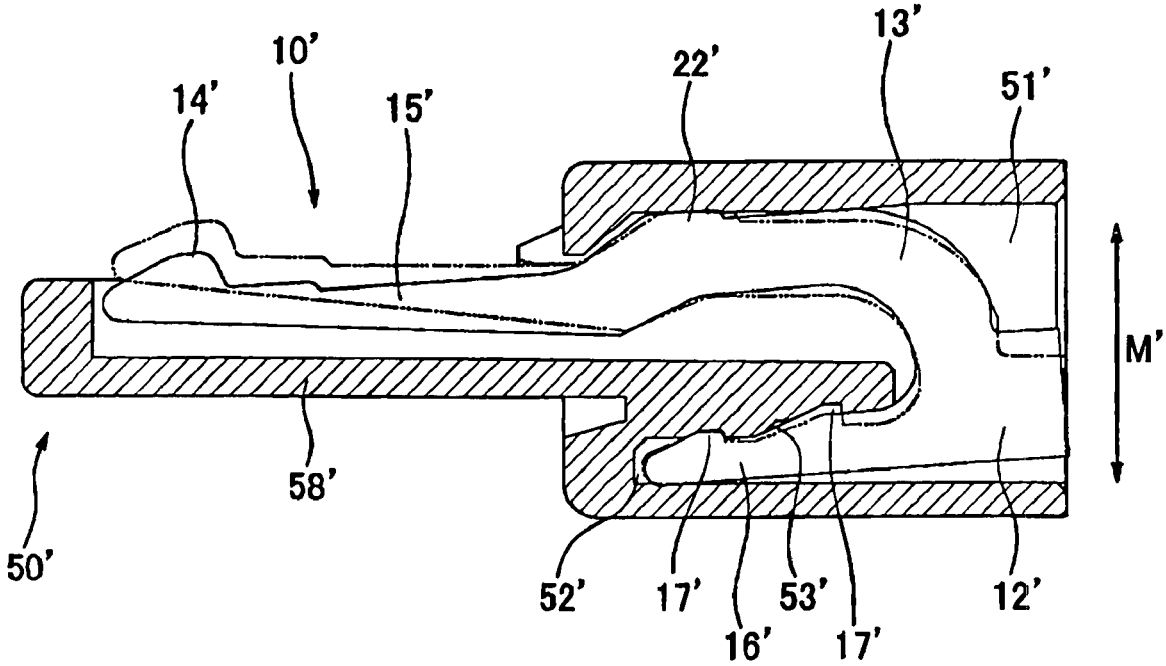
FIG. 7 Prior Art
FIG. 7 is a sectional view showing a conventional plug connector in a state that a locking piece is operated.

FIG. 7 is a sectional view showing a conventional plug connector in a state that a locking piece is operated. As shown in FIG. 7, the conventional plug connector does not have the regulating portions 18. In FIG. 7, components similar to those in the embodiment described above are designated with same reference numerals with an apostrophe.

In the conventional plug connector, it is necessary to securely fix a fixing portion 16' to a housing 50' for supporting an elastic force of a locking piece 10'. Accordingly, a base portion 12' has a thickness increased in a plate surface direction (sheet surface direction) to enlarge a base portion thereof, thereby reducing a load to the fixing portion 16'. Alternatively, the base portion 12' has a length increased in a height direction (indicated with an arrow "M" in FIG. 7) to increase a L length of the moving part, thereby reducing a load to the fixing portion 16'.

In the embodiment of the present invention, when the locking pieces 10 has a size reduced in the height direction, it is necessary to decrease the L length of the moving part. With the configuration of the conventional plug connector, the fixing portion 16' receives an overload and may fail to support the locking piece 10'. As a result, a stress to rotate the locking piece 10' in a displacement direction is generated upon displacement, so that, as shown in FIG. 7, the locking piece 10' rotates and becomes loose inside the housing 50', thereby lowering an inherent elasticity of the locking piece 10'.

Further, when the conventional plug connector is not provided with a print circuit board or the like (not shown), a resin to form the outside cover 2 may flow into and be solidified in a space 51' (in a vertical direction) between the housing 50' and the locking pieces 10', thereby damaging spring function of the locking pieces 10'.

In the present invention, as shown in FIG. 6, the regulating portions 18 are provided for solving the problems of the conventional connector described above. With the regulating portions 18, it is possible to reduce a size in the height direction. At the same time, it is possible to provide the locking pieces 10 with an enough locking force, especially plug-out force. Accordingly, a metallic fatigue of the locking pieces 10 is reduced, and an inadvertent inflow of a resin is prevented.

In the embodiment, the regulating portion 18 mainly includes a narrow width portion 19 on a side of the base portion 12 and a wide width portion 21 on a side of a free edge 20. When the plug connector 1 is fitted into the housing 50, the wide width portions 21 of the regulating portions 18 and bases 23 of the fixing portions 16 completely cover the housing 50 in the height direction thereof. That is, the regulating portions 18 function as a stopper or a lid. The plug connector 1 is securely fixed to the housing 50 in the height direction through the regulating portions 18.

With the configuration shown in FIG. 7, a stress is concentrated inside the bent portions 13. In the embodiment, it is possible to externally disperse the stress, thereby reducing a load inside the bent portions 13. Further, outer portions of the bent portions 13 may function as a spring.

As described above, the plug connector 1 is provided with the regulating portions 18. Accordingly, the connector may be downsized (especially, in the displacement direction of the locking pieces or a height of the connector), while the locking pieces 10 are fixed to the housing 50 securely regardless of repeated plug and unplug actions. Accordingly, the lock may be highly reliable and stable. Further, since the locking pieces 10 completely cover vertical holes (not shown) in the backside of the housing 50 in a vertical direction, there is no space between the housing 50 and the locking pieces 10. Accordingly, an inflow of the resin to form the outside cover 2 may be effectively prevented. As a result, the resin does not ruin a spring characteristic of the locking pieces 10, and thereby the lock may be highly reliable.

A configuration of the first shielding member 70 and the second shielding member 72 will be explained with reference to FIG. 3. As shown in FIG. 3, the first shielding member 70 mainly comprises the shield fitting portion 87 covering the housing fitting portion 58 along the protruding direction thereof; a bending portion 89 covering an upper front wall surface 66 of the housing 50 from before backward; a top wall 91 covering an upper face 68 of the housing 50; and side walls 90 covering an upper half of side surfaces 60 of the housing 50.

In the embodiment, the shield fitting portion 87 is connected with the top wall 91 through the bending portion 89 and is fixed at a lower flat portion 87*e*. Further, slits 78 are provided in the shield fitting portion 87 to place the locking pieces 10. The slits 78 are open at the rear anchor sides 87*i* of the shield fitting portion 87 and closed at a connection portion 87*f* in a front part of the shield fitting portion 87. That is, the shield fitting portion 87 is connected to the bending portion 89 and is provided with an upper flat portion 87*a*, a bent portion 87*h*, and the lower flat portion 87*e*.

In the embodiment, the upper flat portion 87*a* is sandwiched by a pair of the slits 78. The bent portions 87*h* are connected with the bending portion 89 through the connection portion 87*f*. The lower flat portion 87*e* faces and is arranged in parallel to the upper flat portion 87*a*. The upper flat portion 87*a* is provided with a convex portion 87*g* extended in a direction perpendicular to an extending direction with respect to the slits 78. The convex portion 87*g* improves strength of the shield fitting portion 87 and confirms the fitting state of the electrical connector 1 and the receptacle connector.

When the first shielding member 70 is fitted into the housing 50, the rear anchor sides 87*i* of the shield fitting portion 87 are inserted into the grooves 55 of the housing 50 and held there. At this time, the corner protruding portion 61 of the housing 50 covers around roots of the rear anchor sides 87*i* externally from a top part to side surfaces. The rear anchor sides 87*i* is inserted into the grooves 55. Accordingly, the electrical connector 1 may become more resistant to a twisting force.

When the first shielding member 70 is fitted into the housing 50, engaging holes 76 provided in the side walls 90 engage with engaging protrusions 56 provided on the side surfaces 60 of the housing 50. Accordingly, the first shielding member 70 may engage with the housing 50. At this time, the shield fitting portion 87 of the first shielding member 70 covers an approximate circumference of the housing fitting portion 58.

A body of the second shielding member 72 is complement with the first shield member 70. When the first shielding member 70 and the second shielding member 72 are fitted together, the first shielding member 70 and the second shielding member 72 cover the housing fitting portion 58 and outer side circumferences and a rear edge of the housing 50. When the second shielding member 72 is fitted into the housing 50, engaging holes 77 provided on side walls 92 engage with engaging protrusions 57 provided in the side surfaces 60 of the housing 50. The housing 50 thereby engages with the second shielding member 72.

The electrical connector of the present invention is widely applicable to compact electronics and electrical equipment.

The disclosure of Japanese Patent Application No. 2006-282846, filed on Oct. 17, 2006, is incorporated in the application by reference.

While the invention has been explained with reference to the specific embodiments of the invention, the explanation is illustrative and the invention is limited only by the appended claims.

What is claimed is:

1. An electrical connector to be connected to a mating connector, comprising:

a housing having a groove;

a terminal;

a shield member having a slit; and a locking piece arranged in parallel to the terminal for engaging the mating connector and accommodated in the groove and the slit, wherein said locking piece includes a base portion; an arm portion movable by a specific amount; a fixing portion fixed to the housing; and a regulating portion fixed to the housing, said arm portion extending from the base portion toward the mating connector via a bent portion and having a locking portion for engaging an engaged portion of the mating connector at a distal thereof, said fixing portion extending from the base portion toward the mating connector, said regulating portion being situated on an opposite side of the fixing portion with respect to the base portion and extending from the base portion in a moving direction of the arm portion, said locking piece being accommodated in the groove and the slit so that the arm portion bends into the groove through the slit when the electrical connector is connected to the mating connector, wherein said regulating portion includes a narrow width portion situated on a side of the base portion and a wide width portion situated on a side of a free edge thereof.

2. The electrical connector according to claim 1, wherein said housing includes a pressed portion disposed between the arm portion and the fixing portion, said fixing portion having a pressed protrusion pressed into the pressed portion.

3. The electrical connector according to claim 1, wherein said locking piece includes an abutting portion disposed between the locking portion and the bent portion for abutting against an inner wall of the housing.

4. The electrical connector according to claim 1, wherein said locking piece has a flat shape.

5. The electrical connector according to claim 1, wherein said locking portion includes a side surface having a convex shape, said locking portion including a front sloping surface facing the mating connector and having a first angle and a rear sloping surface on an opposite side of the front sloping surface having a second angle larger than the first angle.

6. The electrical connector according to claim 1, wherein said locking piece is accommodated in the groove and the slit so that the locking piece protrudes from the slit when the electrical connector is not connected to the mating connector.

* * * * *